United States Patent [19]

Hefner, Jr.

[11] Patent Number: 4,701,257

[45] Date of Patent: Oct. 20, 1987

[54] FATTY ESTERS OF ALKANOLAMINE HYDROXYALKYLATES AS OXIDIZED COAL CONDITIONER IN FROTH FLOTATION PROCESS

[75] Inventor: Robert E. Hefner, Jr., Lake Jackson, Tex.

[73] Assignee: The Dow Chemical Company, Midland, Mich.

[21] Appl. No.: 826,658

[22] Filed: Feb. 6, 1986

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,178,174 | 10/1939 | Epstein | 209/166 |
| 2,236,528 | 4/1941 | Epstein | 209/166 |
| 2,236,529 | 4/1941 | Epstein | 209/166 |
| 2,389,763 | 11/1945 | Cahn | 252/61 X |
| 4,070,276 | 1/1978 | Broman | 209/166 |
| 4,234,414 | 11/1980 | Hefner | 209/166 |
| 4,253,944 | 3/1981 | Hefner | 209/166 |
| 4,276,156 | 6/1981 | Hefner | 209/166 |
| 4,278,533 | 7/1981 | Hefner | 209/166 |
| 4,330,339 | 5/1982 | Nimerick | 209/166 X |
| 4,474,619 | 10/1984 | Meyer | 252/61 X |

*Primary Examiner*—S. Leon Bashore
*Assistant Examiner*—Thomas M. Lithgow

[57] ABSTRACT

A coal conditioner is set forth in this disclosure. The coal, crushed and sized, is separated more readily on addition of a conditioner prior to flotation separation. The conditioner features fatty esters of alkanolamine hydroxyalkylates having an ether linkage.

20 Claims, No Drawings

FATTY ESTERS OF ALKANOLAMINE HYDROXYALKYLATES AS OXIDIZED COAL CONDITIONER IN FROTH FLOTATION PROCESS

BACKGROUND OF THE DISCLOSURE

This background concerns the froth flotation of oxidized coal and coal-containing solids. In particular, the process involves the use of a novel conditioner class: fatty esters of alkanolamine hydroxyalkylates.

Coal occurs naturally in several different forms, according to local geology. However, the coal happens to occur, one should expect to find varying amounts of undesirable materials present with the carbonaceous solids. For example, sulfur content may be objectionably high in raw coal. Likewise, ash and generally noncombustible materials (such as sand) may be found along with the coal. Whatever the unwanted substances, solid ores in general and coal in particular have been the subject of study relating to the separation of the desired product from the undesired balance.

Froth flotation is well known as an effective method of carrying out such separation. This process exploits a physical difference between the wanted and unwanted solids, to wit, one type of solid particle preferentially wets while the other does not. In that way, agitation of a slurry creates a bubbly surface region in which one type of the pulverized solids may be found. For example, consider a solid mass of materials X and Y. Froth flotation separation of X from Y first requires the solid mass to be pulverized into small particles of different compositions—some particles with more X and some with less X. Next, the particles are agitated in a carefully chosen liquid (probably a mixture rather than a pure liquid). The wetted particles, say predominantly X, remain in the bulk liquid while the unwetted particles, say predominantly Y, are located in the air bubbles of the froth. A simple embodiment of the general idea appears in U.S. Pat. No. 2,389,763. That reference involves removal of silica and siliceous materials from manganese and magnesium ores. The flotation agent in said reference is the heart of the invention, consisting in this case of aliphatic carboxylic acid esters of nontertiary alkylamines. Experience has taught that the precise structure of the flotation agent is critical to the effectiveness of a given separation. This result comes as no surprise, since liquid-liquid extraction and chromatography also exhibit critical sensitivity to small changes in chemical structure of the mixture components.

The specific context of the present invention involves oxidized coal. Such coal has generally been known to be somewhat separable from solid ash, using an air-water system for froth flotation where the water contains some carefully chosen flotation agent. The liquid may contain additional components, such as chemicals intended to adjust the pH or induce bubble formation. In any case successful separation of coal from ash has depended on making the coal particles surface sufficiently hydrophobic. Alkanolamines and their derivatives function reasonably well in industrial separation processes, but since froth flotation of coal depends critically on the exact makeup of the liquid, there remains the question of exactly what flotation agent is appropriate.

U.S. Pat. No. 4,474,619 teaches the use of a condensate of an alkanolamine with at least 0.8 equivalent of a fatty acid. Condensation reactions such as esterification are generally reversible, so the composition of the products will depend strongly on the composition and stoichiometry of the reactants. This reference notes that the preferred ratio of fatty acid or fatty ester to alkanolamine is about 2:1 or 3:1 for yield of the most effective conditioner. A refined kerosene (Soltrol 100) serves as the collector, and the slurry also contained a frother (Dowfroth 1012). Furthermore, this reference recognizes the efficacy of diethanolamine condensed with a commercially available mixture of rosin acids, oleic acid, linoleic acid, stearic acid, etc. This mixture of tall oil fatty acids is generally denominated TOFA, while diethanolamine is denoted by DEA. Thus, one may speak of a 1:2 condensation of DEA/TOFA, for example. A comparison of the present invention with U.S. Pat. No. 4,474,619 appears later in this discussion.

The present invention improves upon the prior art by alkoxylating the alkanolamine. This alkoxylation incorporates ether linkages into the conditioner which distinguish it structurally from coal conditioners of the prior art while providing unexpected improvements in clean coal recovery. For example, this process might employ a 1:3 reaction of DEA with propylene oxide, designated DEA-3PO. That product will then be esterified with TOFA, so one could speak of DEA-3PO-3TOFA. In order to facilitate discussion of the present invention in greater detail, the experimental particulars are set out below. The term "conditioners" as illustrated by the examples below is an agent added in a froth flotation process to enhance coal recovery selectivity and efficiency.

Flotation Procedure

The general flotation procedure comprises crushing the coal to a size suitable for froth flotation and floating the sized coal in a frothing aqueous medium comprising a fuel oil collector and an effective amount of a conditioner corresponding to the formula:

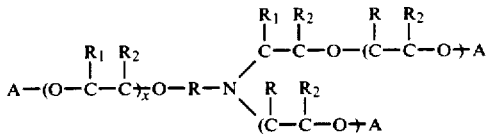

wherein, $R_1$ is any hydrocarbyl group

R is H or an alkyl $R_2$ is H or an alkyl

X is an integer of 1 or more

A is H or

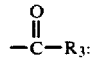

and $R_3$ is an alkyl of from 2 to 36 carbon atoms.

The above conditioner may be an ethoxylaled alkanol amine or a propoxylated alkanol amine or a mixed ethoxylated and propoxylated alkenol amine or ester thereof.

A specific example of the above procedure is as follows.

The coal used was a highly oxidized type containing 14.7% ash (available as Republic Steel Banning #4). The flotation apparatus was a Galigher Agitair equipped with a 3000 ml cell, operating at 10 rpm for the froth collecting paddle.

About 200 g coal was charged to the apparatus with about 2800 ml deionized water, and conditioning of the slurry began at 900 rpm. After 2 minutes the pH was adjusted to 7.0 by addition of 11.0 ml 1N NaOH, followed by 5 minutes of additional conditioning. Then 0.5 ml of the experimental conditioner was added, where the formulation was (by weight %):

5% Conditioner
47.5% Soltrol 100
47.5% Deionized water.

Next, another 0.25 g Soltrol 100 was added. Whenever acetic acid constituted an additional component of the experimental formula, it was present at 5%, and Soltrol was again made up so as to fix the Soltrol/coal feed ratio at 2.5 kg/ton.

After another minute of conditioning, 0.04 ml Dowfroth 1012 (DR-1012) was added, followed by one more minute of conditioning. Experimental protocol required the running of a standard, wherein experimental conditioners were omitted and DR-1012 and Soltrol occurred at concentrations of 0.04 ml DF-1012/2.5 kg Soltrol/-ton coal feed. The actual frothing took place upon a flow of 9 liters/minute of air into the cell, with the froth being collected for 4 minutes. Coal concentrate (froth product) was dried at 110 degrees C.; ash content was determined by loss of weight on ignition of a gram of the coal at 750° C. for 1.5 hours.

Synthesis of Hydroxyalkylated Alkanolamine

Propoxylates of MEA, DEA, and TEA were made at atmospheric pressure using a glass RB reactor-condenser apparatus cooled by Dowtherm. A side-arm vented and calibrated addition funnel was equipped with nitrogen inlet, and the set up included magnetic stirring and thermostatically controlled heating lamps. Alkylene oxide was stoichiometrically added to stirred alkanolamine under nitrogen at between 50 and 190 degrees C. After the reaction commenced, makeup alkylene oxide was added to achieve theoretical final product weight. The reaction took place under base catalyzed conditions (0.25% KOH by weight).

Esterification

Esterified alkanolamine propoxylates were prepared in a glass RB reactor equipped with a steam condenser-Dean Stark trap-cold water condenser assembly, nitrogen sparge tube, magnetic stirring, and thermostatically controlled infrared heating lamps. Reaction occurred under nitrogen at 200 degrees C. for 2 hours, followed by an hour at 225 degrees C. The esterfication can occur by reacting a TOFA with a hydroxyalkylated alkanol amine in a stoichiometric ratio of TOFA to hydroxyalkylated alkanol amine in the range of 2/1 to 5/1.

Infrared analysis verified product structure for both syntheses.

Experimental Results and Examples

The following tables of results illustrate the effectiveness of the present process. For the purposes of these tables the term coal concentrate denotes the recovered solid material from the froth, and coal head means the raw feed charged to the cell, so coal concentrate % = 100 × [g coal concentrate/g coal head];

-continued and clean coal recovery % = coal concentrate % × [1-ash fraction].

EXAMPLE 1

These runs were done using MEA as the alkanolamine precursor to the flotation conditioner.

| Flotation Reagent Type | Coal Recovery % | Clean Coal Recovery % |
|---|---|---|
| MEA-10PO | 40.9 | 35.9 |
| MEA-10PO-2TOFA | 68.2 | 61.0 |
| MEA-36.15PO | 51.0 | 45.4 |
| MEA-36.15PO-2TOFA | 68.2 | 61.5 |
| MEA-36.15PO-8TOFA[1] | 70.1 | 63.5 |
| Standard | 29.7 | 25.8 |

The esterified monoethanolamine propoxylates are clearly useful in coal recovery, and it is interesting to note the decent performance of the nonesterified MEA-36.15PO reagent (taking 40% clean coal recovery as a rough minimum). The flotation conditioner is useful not only in the flotation of oxidized coal but also oxidized bituminous coal.

EXAMPLE 2

These runs were done using DEA as the alkanolamine precursor to the flotation conditioner.

| Flotation Reagent Type | Wt. Coal Head (g) | Wt. Coal Conc. (g) | Ash (%) | Coal Recovery (%) | Clean Coal Recovery (%) |
|---|---|---|---|---|---|
| DEA-2PO | 200.8 | 80.5 | 12.6 | 40.1 | 35.0 |
| DEA-2PO-2TOFA | 200.6 | 140.6 | 10.9 | 70.1 | 62.5 |
| DEA-2PO-3TOFA | 201.2 | 144.1 | 10.2 | 71.6 | 64.3 |
| Standard | 201.3 | 59.7 | 13.0 | 29.7 | 25.8 |
| DEA-10PO | 201.4 | 87.8 | 11.4 | 43.6 | 38.6 |
| DEA-10PO-2TOFA | 200.3 | 136.5 | 9.4 | 68.2 | 61.7 |
| DEA-10PO-3TOFA | 201.9 | 139.2 | 9.3 | 69.0 | 62.5 |
| DEA-10PO-5TOFA[1] | 200.6 | 141.4 | 9.4 | 70.3 | 63 9 |
| Standard | 201.3 | 59.7 | 13.0 | 29.7 | 25.8 |

EXAMPLE 3

These runs were done using TEA as the alkanolamine.

| Flotation Reagent Type | Wt. Coal Head (g) | Wt. Coal Conc. (g) | Ash (%) | Coal Recovery (%) | Clean Coal Recovery (%) |
|---|---|---|---|---|---|
| TEA-2PO | 200.9 | 77.1 | 12.6 | 38.4 | 33.5 |
| TEA-2PO-2TOFA | 200.4 | 141.6 | 11.1 | 70.7 | 62.8 |
| TEA-2PO-5TOFA[1] | 201.2 | 145.0 | 11.2 | 72.1 | 64.0 |
| Standard | 201.3 | 59.7 | 13.0 | 29.7 | 25.8 |
| TEA-10PO | 201.5 | 79.6 | 12.5 | 39.5 | 34.6 |
| TEA-10PO-2TOFA | 201.4 | 136.1 | 11.2 | 67.6 | 60.0 |
| TEA-10PO-5TOFA[1] | 201.0 | 141.8 | 10.7 | 70.6 | 63.0 |

-continued

| Flotation Reagent Type | Wt. Coal Head (g) | Wt. Coal Conc. (g) | Ash (%) | Coal Recovery (%) | Clean Coal Recovery (%) |
|---|---|---|---|---|---|
| Standard | 201.3 | 59.7 | 13.0 | 29.7 | 25.8 |

[1]Minor amounts of unreacted TOFA present as evidenced by infrared spectophotometric analysis.

EXAMPLE 4

These runs were done with acetic acid treated reagents.

| Flotation Reagent Type | Wt. Coal Head (g) | Wt. Coal Conc. (g) | Ash (%) | Coal Recovery (%) | Clean Coal Recovery (%) |
|---|---|---|---|---|---|
| DEA-2PO-3TOFA | 200.7 | 142.3 | 11.2 | 70.9 | 63.0 |
| DEA-10PO-3TOFA | 201.2 | 133.9 | 10.9 | 66.6 | 59.3 |

Comparison of these results with those of Example 2 shows that acetic acid treatment slightly elevated the ash fraction, diminishing clean coal recovery. Nevertheless, industrial conditions may call for such acid treatment in order to further the dispersion of the conditioner. In such an event, the present process still operates. The acid employed may be an inorganic acid as well as the organic acid used above.

EXAMPLE 5

These runs illustrate the merit of the present process, as compared with another process whih uses the nonalkoxylated conditioner. The first entry below is not an embodiment of this invention.

| Flotation Reagent Type | Wt. Coal Head (g) | Wt. Coal Conc. (g) | Ash (%) | Coal Recovery (%) | Clean Coal Recovery (%) |
|---|---|---|---|---|---|
| DEA-2TOFA[2] | 200.8 | 135.6 | 10.1 | 67.5 | 60.7 |
| DEA-2PO-2TOFA | 200.6 | 140.6 | 10.9 | 70.1 | 62.5 |
| DEA-10PO-2TOFA | 200.3 | 136.5 | 9.4 | 68.2 | 61.7 |
| Standard | 201.3 | 59.7 | 13.0 | 29.7 | 25.8 |

[2]Not an embodiment of the present invention; included to exemplify prior art patent.

While the foregoing is directed to the preferred embodiment, the scope is determined by the claims which follow.

What is claimed is:

1. An improved froth flotation process for cleaning coal using alkanolamine hydroxyalkylates or fatty esters thereof comprising the steps of:

(a) crushing the coal to a size suitable for classification by froth flotation; and (b) floating the sized coal in a frothing aqueous medium comprising a fuel oil collector and an effective amount of a conditioner corresponding to the formula:

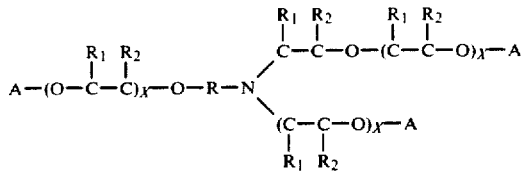

wherein,

R is any hydrocarbyl group;

$R_1$ is H or an alkyl;

$R_2$ is H or an alkyl;

X is an integer of 1 or more;

A is H or

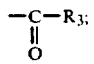

and $R_3$ is an alkyl of from 2 to 36 carbon atoms.

2. The process, as described in claim 1, wherein the conditioner is monoethanolamine propoxylate and X is an integer from 1 to about 100.

3. The process, as described in claim 1, wherein the conditioner is triethanolamine propoxylate and X is an integer from 1 to about 100.

4. The process, as described in claim 1, wherein the conditioner is diethanolamine propoxylate and X is an integer from 1 to about 100.

5. The process, as described in claim 1, wherein the conditioner is an ester of monoethanolamine propoxylate, X is an integer from 1 to about 100 and at least one A is

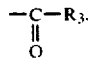

6. The process of claim 5, wherein $R_3$ includes tall oil fatty acids alkyl radicals and the ester of manoethanolamine propoxylate is the esterfied product of a stoichiometric amount of tall oil fatty acid and manoethanol amine propoxylate.

7. The process, as described in claim 6, wherein the tall oil fatty acid stoichiometry is in a ratio to the monoethanolamine propoxylate of from 2/1 to 5/1.

8. The process, as described in claim 1, wherein the conditioner is an ester of diethanolamine propoxylate, X is an integer from 1 to about 100 and at least one A is

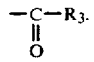

9. The process of claim 8, wherein $R_3$ includes tall oil fatty acids alkyl radicals and the ester of dioethanolamine propoxylates is the esterfied product of stoichiometric amount of tall oil fatty acid and monoethanolamine propoxylate.

10. The process, as described in claim 9, wherein the tall oil fatty acid stoichiometry is in a ratio to the diethanolamine propoxylate of from 2/1 to 5/1.

11. The process, as described in claim 1, wherein the conditioner is triethanolamine propoxylate, X in an integer from 1 to about 100 and at least one A is $$-\underset{\underset{O}{\|}}{C}-R_3.$$

12. The process of claim 11, wherein $R_3$ includes tall oil fatty acids alkyl lradicals.

13. The process, as described in claim 12, wherein the tall oil fatty acid stoichiometry is in ratio to the triethanolamine propoxylate of from 2/1 to 5/1.

14. The process, as described in claim 1, wherein the alkanolamine hydroxyalkylates are ethoxylates.

15. The process, as described in claim 1, wherein the alkanolamine hydroxyalkylates are mixed ethoxylates and propoxylates.

16. The process, as described in claim 1, wherein the coal to be beneficiated has an oxidized surface.

17. The process, as described in claim 16, wherein the coal to be beneficiated is bituminous coal having an oxidized surface.

18. The process, as described in claim 1, wherein the frothing aqueous medium further includes an effective amount of a conventional frothing agent.

19. The process, as described in claim 1, wherein an organic acid or an inorganic acid is added to the conditioner.

20. The process, as described in claim 19, wherein the acid is acetic acid.

* * * * *

UNITED STATES PATENT AND TRADEMARK OFFICE

CERTIFICATE OF CORRECTION

PATENT NO. : 4,701,257

DATED : October 20, 1987

INVENTOR(S) : Robert E. Hefner, Jr.

It is certified that error appears in the above-identified patent and that said Letters Patent is hereby corrected as shown below:

Column 2, lines 40-48, the formula should read--

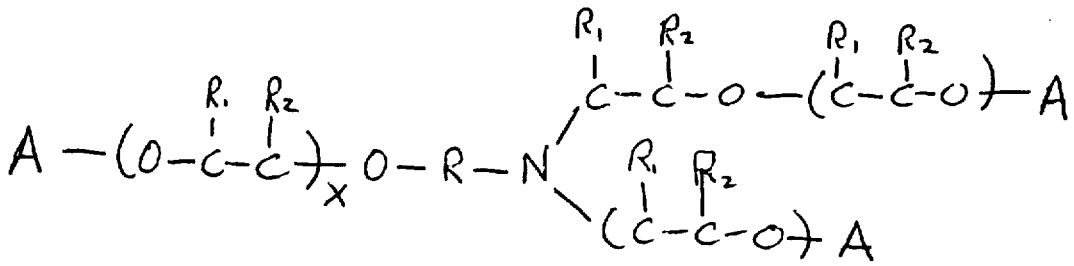

Column 5, line 38, "whih" should read --which--.
Column 6, line 60, "propoxylates" should read --propoxylate--; insert --a-- after the word "of".
Column 7, line 9, "Iradicals" should read --radicals--.

Signed and Sealed this

Eighth Day of August, 1989

*Attest:*

DONALD J. QUIGG

*Attesting Officer*

*Commissioner of Patents and Trademarks*